US010612255B2

(12) United States Patent
Hutzenlaub

(10) Patent No.: US 10,612,255 B2
(45) Date of Patent: Apr. 7, 2020

(54) BUILDING AND METHOD FOR PRODUCING A CLEAN AREA

(71) Applicant: MECORA MEDIZINTECHNIK GMBH, Aachen (DE)

(72) Inventor: Jens Hutzenlaub, Aachen (DE)

(73) Assignee: MECORA MEDIZINTECHNIK GMBH, Aachen (DE)

( * ) Notice: Subject to any disclaimer, the term of this patent is extended or adjusted under 35 U.S.C. 154(b) by 0 days.

(21) Appl. No.: 16/517,569

(22) Filed: Jul. 20, 2019

(65) Prior Publication Data

US 2019/0360223 A1 Nov. 28, 2019

Related U.S. Application Data

(63) Continuation of application No. PCT/EP2018/053974, filed on Feb. 19, 2018.

(30) Foreign Application Priority Data

Feb. 21, 2017 (DE) ..... 10 2017 103 468

(51) Int. Cl.
*E04H 1/12* (2006.01)
*F24F 3/16* (2006.01)

(52) U.S. Cl.
CPC ..... *E04H 1/1277* (2013.01); *F24F 3/161* (2013.01)

(58) Field of Classification Search
CPC ..... E04H 1/125; E04H 1/1277; E04H 15/22; E04H 15/26; F24F 3/161
See application file for complete search history.

(56) References Cited

U.S. PATENT DOCUMENTS 2,649,101 A * 8/1953 Suits ..... E04H 15/22 52/2.16
4,567,696 A * 2/1986 Malet ..... E04H 15/22 52/2.24
4,707,953 A 11/1987 Anderson
5,101,604 A * 4/1992 Wardlaw, III ..... B23K 9/321 135/116
5,603,185 A 2/1997 Murphy
(Continued)

FOREIGN PATENT DOCUMENTS

DE 1684561 A1 11/1971
EP 0075483 A1 * 3/1983 ..... E04H 1/1277
(Continued)

*Primary Examiner* — Christine T Cajilig
(74) *Attorney, Agent, or Firm* — Von Rohrscheidt Patents

(57) ABSTRACT

A building including at least one pressure lock configured to facilitate an exchange of materials and persons between the building and a clean area in the building; a ventilation arrangement configured to feed supply air from the building into a top of the clean area; and an extraction arrangement configured to extract exhaust air from a bottom of the clean area into the building so that the clean area has a positive pressure relative to the building, wherein the clean area includes a floor and a shell that encloses the clean area above the floor pressure tight, wherein the building includes an outer enclosure that protects the clean area against weather conditions outside the building, wherein the shell is flexible at least in a major portion of a surface area of the shell and the positive pressure moves the shell into a shape of the clean area.

10 Claims, 2 Drawing Sheets

(56) References Cited

U.S. PATENT DOCUMENTS

| | | | | |
|---|---|---|---|---|
| 6,508,850 | B1 * | 1/2003 | Kotliar | A61G 10/005 55/385.2 |
| 2010/0083586 | A1 * | 4/2010 | Page | E04H 15/22 52/2.11 |

FOREIGN PATENT DOCUMENTS

| | | | | |
|---|---|---|---|---|
| FR | 2338356 | A1 * | 8/1977 | E04H 15/22 |
| WO | WO2005052319 | A1 | 6/2005 | |
| WO | WO2015192201 | A1 | 12/2015 | |
| WO | WO-2016192843 | A1 * | 12/2016 | A62C 2/06 |
| WO | WO-2017102568 | A1 * | 6/2017 | A01G 10/005 |

* cited by examiner

BUILDING AND METHOD FOR PRODUCING A CLEAN AREA

RELATED APPLICATIONS

This application is a continuation of International Application PCT/EP2018/053974 filed on Feb. 19, 2018 claiming priority from German Patent Application DE 10 2017 103 468.4 filed on Feb. 21, 2017, both of which are incorporated in their entirety by this reference.

FIELD OF THE INVENTION

The invention relates to a building including at least one pressure lock for the exchanging materials and persons between the building and a clean area in the building.

BACKGROUND OF THE INVENTION

Clean areas of this type are generally known from WO 2013/127979 A1 and DE 32 35 927 C1 as clean rooms or ultra clean rooms that are provided with pressurized cleaned ambient air in order to prevent a contamination with particles and germs that are present in the ambient atmosphere. In clean areas of this type frequent particle measurements are performed during construction and operation with facilitate a classification in particular according to ISO 14644. A pressure lock prevents excessive pressure loss during entry or exit of material and persons between the clean area and its environment in the building.

When configuring clean rooms and in particular when reconfiguring an existing room into a clean room surface loads generated by the positive pressure and impacting the base and the shell, thus walls and ceiling, have to be considered.

WO 2008 023 206 A2 discloses an inflatable tunnel for painting motor vehicles outside of buildings. DE 25 23 512 A1 and U.S. Pat. No. 3,159,165 discloses air inflated structures and U.S. Pat. No. 5,603,185 A discloses an inflatable play house. U.S. Pat. No. 5,101,504 discloses an explosion protected shell for subterraneous welding, U.S. Pat. No. 4,707,953 discloses a tent configured from individual segments. WO 2015/192201 A1 discloses an inflatable house, DE 16 84 561 A1 discloses a tent with an inflatable double wall, WO 2005/052319 A1 discloses an inflatable subterraneous shelter, DE 696 17 477 T2 discloses a Hypoxia training room and DE 699 34 668 T2 discloses a wafer air lock chamber.

BRIEF SUMMARY OF THE INVENTION

It is an object of the invention to simplify the fabrication of a clean area.

The object is achieved by a building including at least one pressure lock configured to facilitate an exchange of materials and persons between the building and a clean area in the building; a ventilation arrangement configured to feed supply air from the building into a top of the clean area; and an extraction arrangement configured to extract exhaust air from a bottom of the clean area into the building so that the clean area has a positive pressure relative to the building, wherein the clean area includes a floor and a shell that encloses the clean area above the floor pressure tight, wherein the building includes an outer enclosure that protects the clean area against weather conditions outside the building, wherein the shell is flexible at least in a major portion of a surface area of the shell and the positive pressure moves the shell into a shape of the clean area, and wherein the positive pressure supports the shell in the shape of the clean area.

The object is also achieved by a method for producing a clean area in a building that includes an outer enclosure that protects the clean area from weather conditions outside of the building, at least one pressure lock configured to facilitate an exchange of materials and persons between the building and the clean area, a floor and a shell that encloses the clean area above the floor pressure tight in the building that includes an outer enclosure which protects the clean area against weather conditions outside the building, a ventilation arrangement configured to feed supply air from the building into a top of the clean area, and an extraction arrangement configured to extract exhaust air from a bottom of the clean area the clean area into the building so that the clean area has a positive pressure relative to the building, wherein the shell is flexible at least in a major portion of a surface area of the shell, the method including the steps: moving the shell into a shape of the clean area through the positive pressure; and generating the positive pressure by feeding the feed air through the ventilation arrangement.

Improving upon known buildings, it is proposed according to the invention that the shell is at least flexible to a large extent and the positive pressure bring the shell into a shape of the clean area keeps the shell in the shape of the clean area, A clean area of this type can be fabricated self-supporting within a building without the positive pressure imparting additional surface loads onto walls and ceilings of the building during operations.

Advantageously the ventilation arrangement exhausts air from the interior space of the clean area according to the invention through a cavity in at least one column enveloped by the clean area into the ambient of the clean area. Clean rooms are typically vented proximal to the ground in particular by ventilation flaps arranged at the exterior walls. Furthermore it is known to ventilate large clean areas additionally through columns arranged in the clean area. A column arranged in a clean area according to the invention, provides the additional option to anchor the flexible ceiling at an additional point on the ground besides anchoring it at the walls in order to limit the internal height of the clean area.

Advantageously a clean area according to the invention includes a support arrangement for supporting an illumination device in the clean area. A support device that is typically arranged above a head also facilitates arranging air outlets of the ventilation arrangement in addition to the illumination device.

Advantageously the shell of the clean area according to the invention is transparent at least in sections. A clean area of this type facilitates a line of sight into the building outside the clean area for persons working in the clean area through the transparent sections of the shell. Alternatively or additionally non-transparent sections of the shell can be used as a projection surface for example for indirectly illuminating or graphically configuring the clean area for changing technical information or also for moving images e.g. for transmitting a video conference.

Advantageously the shell in a clean area according to the invention includes a fabric at least in sections. The reinforcement of the shell with the fabric prevents an undesirable expansion of the shell due to the positive pressure.

Advantageously a clean area according to the invention has a symmetrical plan form, in particular a point symmetrical plan form. The ventilation device can be simply configured so that the clean area has homogenous flow properties.

Advantageously a clean area according to the invention includes an essentially vertical lateral wall. Thus, the clean area does not require any additional installation surface in addition to its walkable useable surface.

Advantageously a clean area according to the invention includes a cambered clean area ceiling. The cambered ceiling conveys an optical impression of a tall clean area.

Advantageously a clean area according to the invention is a clean room. A clean room is a clean area that is certified according to EN ISO 14644. Alternatively a clean area according to the invention can have a lower clean level according to VDA 19 part 2 and can be used in particular as a non-regulated clean area (SaS0), as clean zone (SaS1) or as a clean room (SaS2).

Improving upon the known method it is proposed according to the invention that the shell is at least flexible to a large extent and that the positive pressure keeps the shell in the shape of the clean area. The method according to the invention provides the clean areas according to the invention described supra and has the advantages described supra.

BRIEF DESCRIPTION OF THE DRAWINGS

The invention is subsequently described based on an embodiment with reference to drawing figures, wherein.

DETAILED DESCRIPTION OF THE INVENTION

Figure 1:
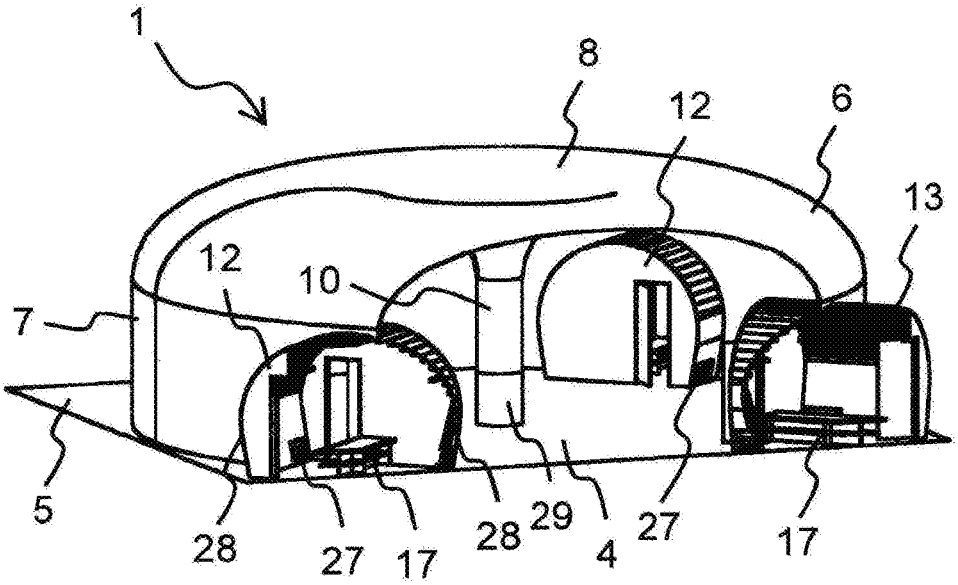
FIG. 1 illustrates a sectional view of the clean area according to the invention.
Figure 2:
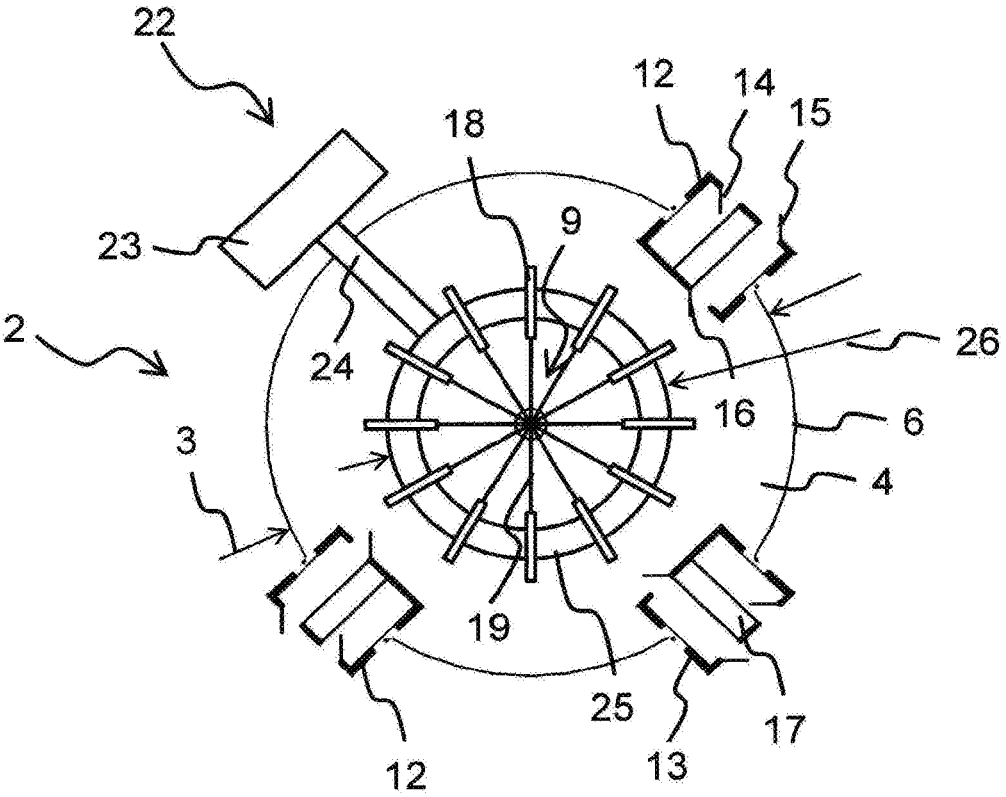
FIG. 2 illustrates a plan form of the clean area.
Figure 3:
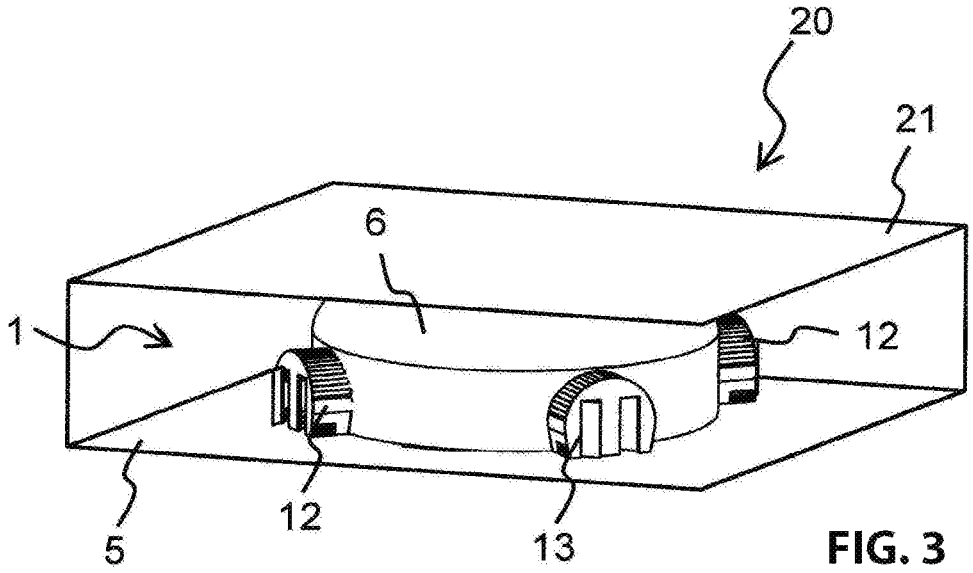
FIG. 3 illustrates an additional view of the clean area.
Figure 4:
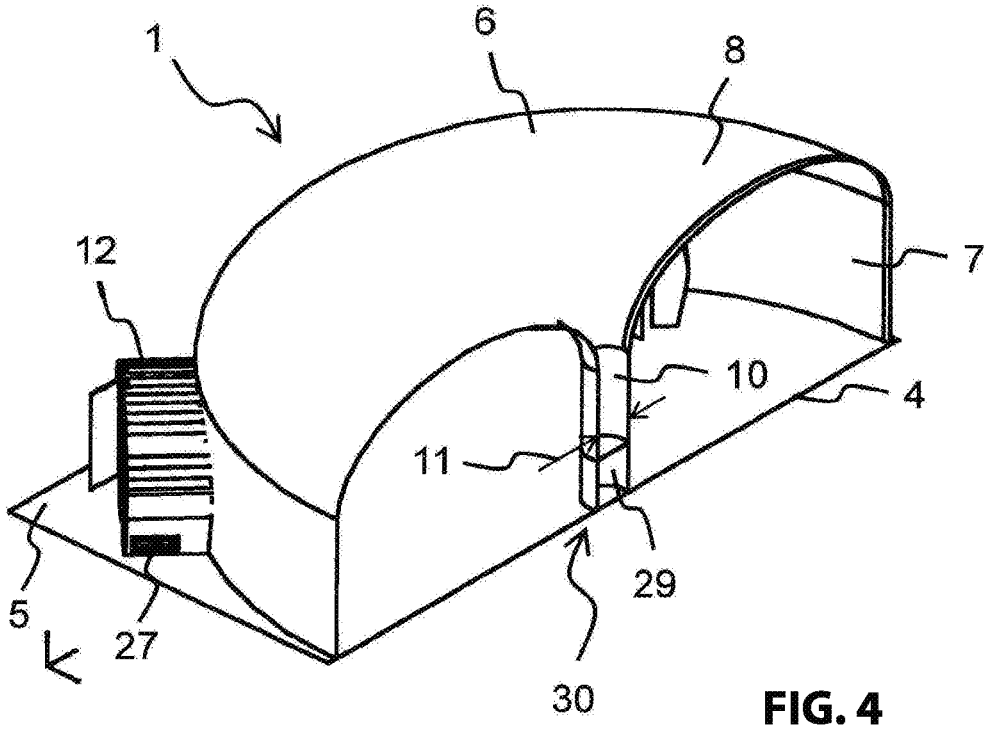
FIG. 4 illustrates an additional sectional view of the clean area.

The clean area 1 according to the invention illustrated in the drawing figures, has a circular essentially point symmetrical plan form 2 with a diameter 3 of 13 meters and a walkable useable surface 4 of 130 $m^2$. A flexible shell 6 that is anchored on the base 5 forms an essentially vertical lateral wall 7 and a torus shaped cambered ceiling 8 and a column 10 with a diameter 11 of 80 cm in a center 9 of the clean area 1.

The shell 6 is made to a large extent from a polyurethane coated fabric which is interrupted in the portion of the walls 7 in a large surface area by a clear PVC foil with a thickness of 0.5 mm. Individual fields of the shell 6 are connected by zippers in order to simplify storage, transportation and erecting and deconstructing of the shell 6. The foil, the fields and the zippers are not illustrated.

The clean area 1 includes two pressure locks 12 that are arranged opposite to each other for persons, e.g. separately for women and men and a pressure lock 13 for material arranged between the pressure locks 12. The pressure locks 12, 13 respectively include an external door 14 and an escape door 15 towards the outside and an inner door 16 towards the clean area 1. A sitting bench 17 is arranged between the external door 14 and the internal door 16 where the persons entering the clean area 1 can change from street clothes into clean area clothes or pull over corresponding protective clothing or take off protective clothing when leaving the clean area 1. The pressure locks 12, 13 include a non-illustrated support structure made from steel profiles.

A support device 18 is arranged below the ceiling 8 of the clean area 1 above head level. The support device 18 is suspended at non-illustrated chains that are run through the ceiling 8 of the clean area 1 wherein the chains are suspended on an outside of the clean area 1 at a support spider 19 that stands in the column 10. Non illustrated illumination elements for illuminating the clean area 1 are arranged at the support device 18.

The clean area 1 is arranged in an interior of a building 20. The building 20 is a commercial building with an outer shell 21 made from standardized light weight prefabricated elements with a support structure made from welded steel profiles. The prefabricated elements and the support structure are not illustrated.

The ventilation arrangement 22 of the clean area 1 includes a ventilation device 23 that is set up adjacent to the clean area 1 and that pulls ambient air from an interior of the building 20, filters it through several filtration stages and blows the cleaned air through a flexible feed hose 24 with 20 Pa positive pressure and 200 into the clean area 1. The feed hose 24 leads into a flexible filter hose 25 with a flow cross section of 3300 $cm^2$ which is run in an annular manner with a diameter 26 of 7 meters in the support device 18 below the ceiling 8 of the clean area 1.

The ventilation arrangement of the clean area 1 includes two respective weight loaded exhaust air flaps 27 in both side walls 28 of the pressure locks 12, 13 and on the other hand side a grid plate that is bent into a drum 29 and that rests on the ground 5 at a base of the column 10. The exhaust air flaps 27 run the exhaust air flow with a pressure difference of 10 Pa respectively from the clean area 1 into the pressure locks 12, 13 and from the pressure locks into the ambient of the clean area 1 in the building 20. The column 10 absorbs an exhaust air flow of approximately 80 $m^3$/min and each of the exhaust air flap 27 absorbs an exhaust air flow of approximately 20 $m^3$/min.

In order to fabricate the clean area 1 the drum 29, the support spider 19 and the support device 18 with the filter hose 25 and the illumination elements and the support structures of the pressure locks 12, 13 are initially built and anchored on the ground 5 and covered with the associated fields of the shell 6. Thereafter the additional fields are connected by the zippers in order to form the shell 6 and the shell 6 is anchored at the ground 5. The clean area 1 is provided with its final torus shape by pressurization through the air feed hose 24.

In order to deconstruct or move the clean area 1, the positive pressure is vented initially, the anchors of the shell 6 at the ground 5 are disengaged, and the fields of the shell 6 are separated by the zippers and disengaged from the drum 29, the support device 18 and the support structures of the pressure locks 12, 13. The filter hose 25 and the illumination are removed from the support device 18 and finally the support device 18 itself, the support spider 19, the drum 29 and the support structures of the pressure locks 12, 13 are taken down.

REFERENCE NUMERALS AND DESIGNATIONS

1 clean area
2 plan form
3 diameter
4 useable surface
5 base
6 shell
7 wall
8 ceiling
9 center
10 column
11 diameter

12 pressure lock
13 pressure lock
14 outer door
15 escape door
16 inner door
17 sitting bench
18 support device
19 support spider
20 building
21 outer shell
22 ventilation arrangement
23 ventilation device
24 feed air hose
25 filter hose
26 diameter
27 exhaust air flap
28 wall
29 drum
30 base

What is claimed is:

1. A building, comprising:

at least one pressure lock configured to facilitate an exchange of materials and persons between the building and a clean area in the building;

a ventilation arrangement configured to feed supply air from the building into a top of the clean area; and an extraction arrangement configured to extract exhaust air from a bottom of the clean area into the building so that the clean area has a positive pressure relative to the building, wherein the clean area includes a floor and a shell that encloses the clean area above the floor pressure tight, wherein the building includes an outer enclosure that protects the clean area against weather conditions outside the building, wherein the shell is flexible at least in a major portion of a surface area of the shell and the positive pressure moves the shell into a shape of the clean area, wherein the positive pressure supports the shell in the shape of the clean area, wherein the at least one pressure lock includes an inner door towards the clean area, and wherein a pressure in the at least one pressure lock is lower than a pressure in the clean area when the inner door towards the clean area is closed.

2. A building, comprising:

at least one pressure lock configured to facilitate an exchange of materials and persons between the building and a clean area in the building;

a ventilation arrangement configured to feed supply air from the building into a top of the clean area; and an extraction arrangement configured to extract exhaust air from a bottom of the clean area into the building so that the clean area has a positive pressure relative to the building, wherein the clean area includes a floor and a shell that encloses the clean area above the floor pressure tight, wherein the building includes an outer enclosure that protects the clean area against weather conditions outside the building, wherein the shell is flexible at least in a major portion of a surface area of the shell and the positive pressure moves the shell into a shape of the clean area, wherein the positive pressure supports the shell in the shape of the clean area, and wherein the ventilation arrangement exhausts air from an interior space of the clean area through a cavity in at least one column that is enveloped by the clean area.

3. The building according to claim 2, further comprising a support device that is configured to support an illumination arrangement in the clean area.

4. The building according to claim 1, wherein the shell is transparent at least in sections of the shell.

5. The building according to claim 1, wherein the shell includes fabric at least in sections of the shell.

6. The building according to claim 1, wherein the clean area has a symmetrical plan form.

7. The building according to claim 1, wherein the clean area includes an essentially vertical lateral wall.

8. The building according to claim 1, wherein the clean area includes a cambered ceiling.

9. The building according to claim 1, wherein the clean area is a clean room.

10. A method for producing a clean area in a building that includes an outer enclosure that protects the clean area from weather conditions outside of the building, at least one pressure lock configured to facilitate an exchange of materials and persons between the building and the clean area, a floor and a shell that encloses the clean area above the floor pressure tight in the building that includes an outer enclosure which protects the clean area against weather conditions outside the building, a ventilation arrangement configured to feed supply air from the building into a top of the clean area, and an extraction arrangement configured to extract exhaust air from a bottom of the clean area the clean area into the building so that the clean area has a positive pressure relative to the building, wherein the shell is flexible at least in a major portion of a surface area of the shell, wherein the at least one pressure lock includes an inner door towards the clean area, and wherein a pressure in the at least one pressure lock is lower than a pressure in the clean area when the inner door towards the clean area is closed the method comprising the steps:

moving the shell into a shape of the clean area through the positive pressure; and generating the positive pressure by feeding the feed air through the ventilation arrangement.

* * * * *